US008863712B2

(12) United States Patent
Schafer et al.

(10) Patent No.: US 8,863,712 B2
(45) Date of Patent: Oct. 21, 2014

(54) CONFIGURATION OF A TANK CONNECTION IN A CAMSHAFT ADJUSTER WITH VOLUME ACCUMULATOR

(71) Applicant: Schaeffler Technologies AG & Co. KG, Herzogenaurach (DE)

(72) Inventors: Jens Schafer, Herzogenaurach (DE); Martin Steigerwald, Herzogenaurach (DE); Michael Busse, Herzogenaurach (DE); Jurgen Plate, Gerhardshofen (DE); Andreas Wedel, Emskirchen (DE); Olaf Boese, Nuremberg (DE); Steffen Racklebe, Obemichelbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/747,792

(22) Filed: Jan. 23, 2013

(65) Prior Publication Data

US 2013/0199471 A1 Aug. 8, 2013

(51) Int. Cl.
*F01L 1/34* (2006.01)
*F01L 1/344* (2006.01)

(52) U.S. Cl.
CPC ..... *F01L 1/3442* (2013.01); *F01L 2001/34479* (2013.01); *F01L 2001/34446* (2013.01); *F01L 2001/34433* (2013.01)
USPC ..... 123/90.17; 123/90.15

(58) Field of Classification Search
CPC ..... F01L 1/34; F01L 1/3442
USPC ..... 123/90.15, 90.17, 90.31
See application file for complete search history.

(56) References Cited

U.S. PATENT DOCUMENTS

| | | | | |
|---|---|---|---|---|
| 7,237,518 | B2 * | 7/2007 | Oh | 123/90.33 |
| 7,610,883 | B2 * | 11/2009 | Noguchi | 123/90.17 |
| 2012/0111295 | A1 | 5/2012 | Plate et al. | |

FOREIGN PATENT DOCUMENTS

| | | |
|---|---|---|
| WO | 2011032805 | 3/2011 |

* cited by examiner

*Primary Examiner* — Zelalem Eshete
(74) *Attorney, Agent, or Firm* — Volpe and Koenig, P.C.

(57) ABSTRACT

A camshaft adjuster (4) for a camshaft (12) of an internal combustion engine (2). The camshaft adjuster (4) includes a stator (20), a rotor (22) housed concentrically in the stator (20) and mounted rotatably about a rotational axis (78) relative to the stator (20), and a volume accumulator (70) for receiving a hydraulic fluid from a pressure chamber (44) formed between the rotor (22) and the stator (20). The volume accumulator (70) has an outlet (76) in a direction of the rotational axis (78).

10 Claims, 4 Drawing Sheets

CONFIGURATION OF A TANK CONNECTION IN A CAMSHAFT ADJUSTER WITH VOLUME ACCUMULATOR

INCORPORATION BY REFERENCE

The following documents are incorporated herein by reference as if fully set forth: German Patent Application No.: 10 2012 201 558.2, filed Feb. 2, 2012.

FIELD OF THE INVENTION

The invention relates to a camshaft adjuster for a camshaft of an internal combustion engine and to the internal combustion engine.

BACKGROUND

Camshaft adjusters are technical component groups for adjusting the phase positions between a crankshaft and a camshaft in an internal combustion engine.

From WO 2011 032 805 A1 it is known to arrange in a camshaft adjuster a volume accumulator from which hydraulic fluid can be drawn out from the pressure chambers in the event of an underpressure.

SUMMARY

The objective of the invention is to improve the known camshaft adjuster in terms of functionality.

This objective is met by one or more features of the invention. Preferred developments are described below and in the claims.

The invention provides arranging an outlet on the volume accumulator of the camshaft adjuster, which outlet is directed in the direction of a rotational axis of the stator and rotor.

This is based on the idea that in the volume accumulator of the type mentioned at the beginning an outflow is to be provided which will discharge a hydraulic fluid, stored in the volume accumulator for compensating underpressure in the pressure chambers, again when the volume accumulator overflows. If the outflow were not present, a hydraulic fluid pressure would build up in the volume accumulator and counteract the outflow of hydraulic fluid from the pressure chambers. In this way the volume flow from the pressure chambers would reduce whereby the adjusting speed of the camshaft adjuster would consequently drop.

Based on this consideration the invention recognizes that the hydraulic fluid ought to drain radially inwards. In this way, the hydraulic fluid flowing into the volume accumulator collects as a result of the centrifugal force at the wall of the volume accumulator, which seen in the radial direction lies furthest outwards, and fills the volume accumulator radially inwards with increasing inflow.

The invention therefore provides a camshaft adjuster for a camshaft of an internal combustion engine. The camshaft adjuster comprises a stator, a rotor housed concentrically in the stator and mounted rotatably about a rotational axis relative to the stator, and a volume accumulator for receiving hydraulic fluid from a pressure chamber formed between the rotor and the stator. The volume accumulator thereby has an outlet in the direction of the rotational axis.

Through the radially inwardly directed outlet, the volume accumulator can be utilized efficiently during operation of the camshaft adjuster when the latter rotates with the camshaft of an internal combustion engine.

In a development of the invention the camshaft adjuster comprises a tank connection connected to the volume accumulator through the outlet for discharging the hydraulic fluid to a tank, wherein the tank connection is arranged radially lower than the volume accumulator. Since the tank connection lies radially lower than the volume accumulator, the volume accumulator must first be filled completely with hydraulic fluid before an overflow of hydraulic fluid can be discharged via the tank, so that it is ensured that the volume accumulator is filled completely during operation of the camshaft adjuster.

It is particularly preferred if the outlet is thereby arranged on the radially innermost side of the volume accumulator. This development is based on the consideration that not only the excess oil flows out of the volume accumulator through the outlet, but also the air separated out from the hydraulic fluid also flows through this same outlet. While the hydraulic fluid flows into the volume accumulator when starting up the engine, air foams up with the hydraulic fluid. Before the hydraulic fluid flows into the pressure chambers again, the air must again be separated out from the hydraulic fluid. The centrifugal force effect in the volume accumulator is used for this. The heavy hydraulic fluid flows radially outwards in the volume accumulator, while the lighter air collects radially at the inside. Through the continual filling of the volume accumulator the air is then forced out of the volume accumulator.

The outlet can have any type of cross section and can be adapted to the surroundings in the camshaft adjuster dependent on application. More particularly the outlet can thereby have a circular, kidney-shaped or rectangular cross section.

In another development of the invention the camshaft adjuster comprises an axial front side and an axial rear side opposite the axial front side. The outlet is thereby arranged on the axial front side and/or on the axial rear side.

Moreover the outlet can be formed from several individual channels which connect the volume accumulator by way of example to the tank. The more channels there are, the lower is the throttle resistance between the accumulator and the tank, whereby large cross sections can be provided with short pipeline lengths.

In a particular development of the invention, the camshaft adjuster comprises a valve in the outlet, which is provided for opening the outlet based on an operation of the internal combustion engine. This development is based on the consideration that when shutting down the internal combustion engine the camshaft and thus the camshaft adjuster also stand still, since both are driven by the crankshaft. At the same time the rotation-dependent centrifugal force also decreases in the volume accumulator. The hydraulic fluid drops radially inwards as a result of gravity and flows out through the outlet by way of example into the tank. It has been shown from experiments that only about a third of the hydraulic fluid remains in the volume accumulator. It has been shown that the residual volume of the remaining hydraulic fluid is dependent on the positioning of the outlet. The shorter the distance between the tank channels and rotational axis so the greater is the residual volume of the remaining hydraulic fluid. When starting up the engine the hydraulic fluid which has flowed out must first be conveyed again into the volume accumulator before the volume accumulator is completely filled again. The undesired oil foaming already mentioned can thereby result. In order to avoid this oil foaming, the development further provides preventing the hydraulic fluid from flowing out of the volume accumulator by arranging the valve in the outlet, which valve is open when the engine is operated and is closed when the engine is shut down. The implementation of a valve is for example well suited for internal combustion engines with a start/stop system, since through the valve the fully functional volume accumulator can be made available directly when restarting the engine.

In a particular development of the invention, the valve comprises a closing body which is movable radially relative to the rotational axis. The closing body is to be arranged movable radially outwards into the volume accumulator. In this way the valve is formed like a non-return valve which opens and closes based on the centrifugal force during the operation of the camshaft adjuster.

So that the closing body does not move too far from the outlet into the volume accumulator, retaining means should be provided. This can be by way of example a cage. The closing body is preferably counter-supported by a spring on the outlet. The spring can be designed as a compression or tension spring. It could thereby particularly preferably be directed so that its axis is directed coaxial with the centrifugal force direction, thus, seen from the outlet, radially outwards into the volume accumulator. The spring force determines the state of the valve. If the spring force is greater than the centrifugal force, then the valve remains closed. If the centrifugal force is greater than the spring force then the valve is opened. Since the centrifugal force is dependent on the crankshaft speed, the spring can be designed so that the valve is closed up to an engine speed below idling speed and is opened above this.

The closing body can have any shape which can be adapted dependent on application to the geometry and requirements of the outlet. In particular the shape of the closing body can have the shape of a ball, a cone or a plate.

In an alternative development of the invention, the valve is a pressure-relief valve. The pressure-relief valve is closed in the event of ambient pressure, when the internal combustion engine is not in operation. As soon as an adjustment with the camshaft adjuster is initiated, the alternating torque of the camshaft presses the hydraulic fluid oil out of the pressure chamber through the control valve into the volume accumulator. So long as the pressure-relief valve is closed a slight hydraulic fluid pressure builds up in the volume accumulator. If the opening pressure of the pressure-relief valve is reached, then the pressure-relief valve opens and the hydraulic fluid can flow out into the tank. If no adjustment of the camshaft takes place then the hydraulic fluid pressure drops again and the pressure-relief valve closes again. This solution is likewise well suited for internal combustion engines having start/stop systems in which the hydraulic fluid need only be kept in the volume accumulator for a short time.

The invention also provides an internal combustion engine which comprises a combustion chamber, a crankshaft driven by the combustion chamber, a camshaft controlling the combustion chamber, and a proposed camshaft adjuster for transferring rotational energy from the crankshaft to the camshaft.

In a development of the invention the proposed internal combustion engine comprises a cylinder head for mounting the camshaft, wherein the outlet is guided through the cylinder head. The development is based on the consideration that the hydraulic fluid could be discharged into the surroundings of the camshaft adjuster, which however ought to be avoided for environmental reasons. The outflow of the hydraulic fluid from the volume accumulator could also take place directly into a chain case so that the hydraulic fluid could flow from there directly back into the tank. This solution could however not be used in the case of a camshaft adjuster having a belt pulley drive. Therefore the hydraulic fluid is particularly preferably however directed back into the cylinder head and from there into the tank.

BRIEF DESCRIPTION OF THE DRAWINGS

Exemplary embodiments of the invention will now be explained in further detail below with reference to a drawings, in which.

DETAILED DESCRIPTION OF THE PREFERRED EMBODIMENTS

Figure 1:
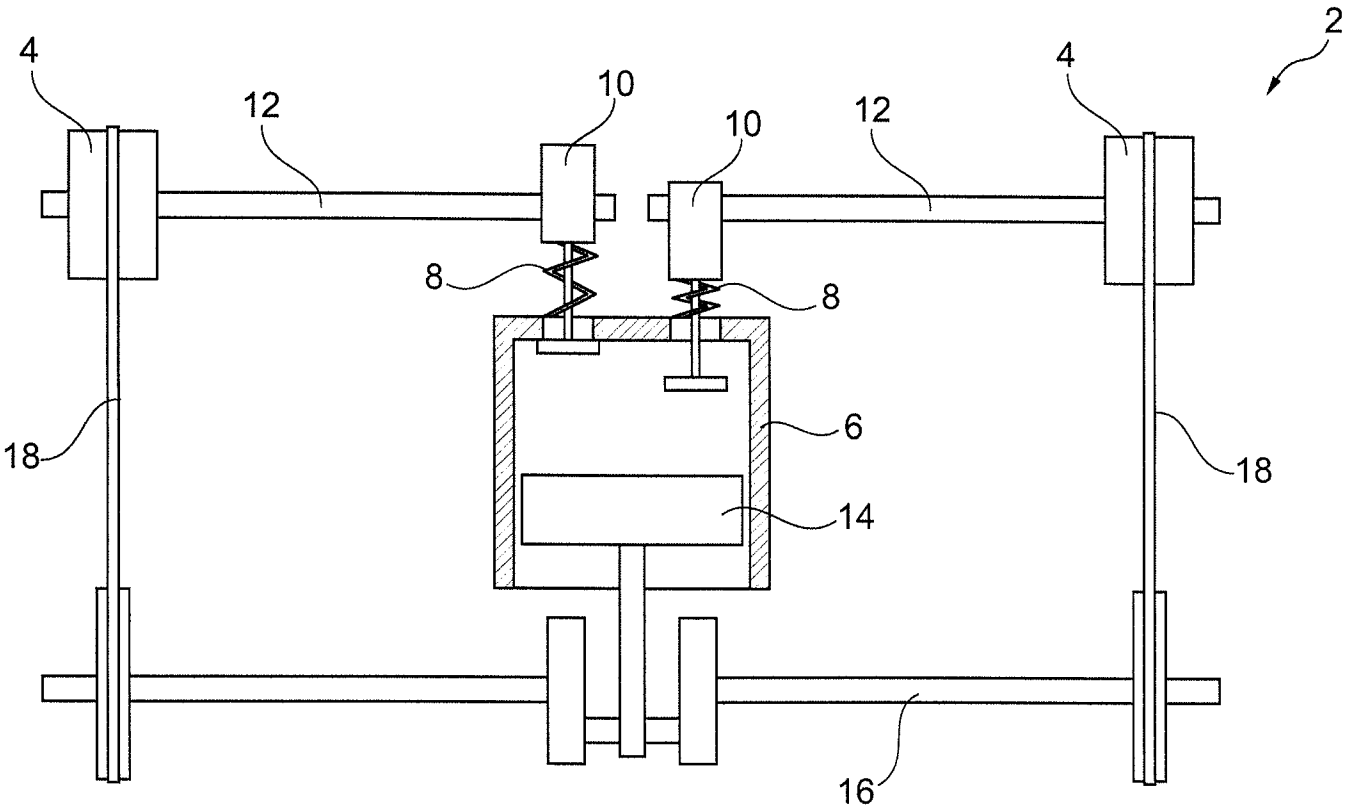
FIG. 1 shows a diagrammatic representation of an internal combustion engine with camshaft adjusters.

In the figures, the same elements are provided with the same reference numerals and will be described only once.

Reference is made to FIG. 1 which shows a diagrammatic representation of an internal combustion engine 2 with camshaft adjusters 4.

The internal combustion engine 2 comprises in a manner known per se a combustion chamber 6 which can be opened and closed by valves 8. The valves are activated by cams 10 on corresponding camshafts 12. Furthermore a reciprocating piston 14 is housed in the combustion chamber 6 and drives a crankshaft 16. The rotational energy of the crankshaft 16 is transferred at its axial end via drive means 18 to the camshaft adjusters 4. In the present example the drive means can be a chain or a belt.

The camshaft adjusters 4 are each set axially on one of the camshafts 12, receive the rotational energy of the drive means 18 and transmit this to the camshafts 12. The camshaft adjusters 4 can thereby temporarily delay or accelerate the rotation of the camshafts 12 relative to the crankshaft 14 in order to change the phase position of the camshafts 12 relative to the crankshaft 16.

Figure 2:
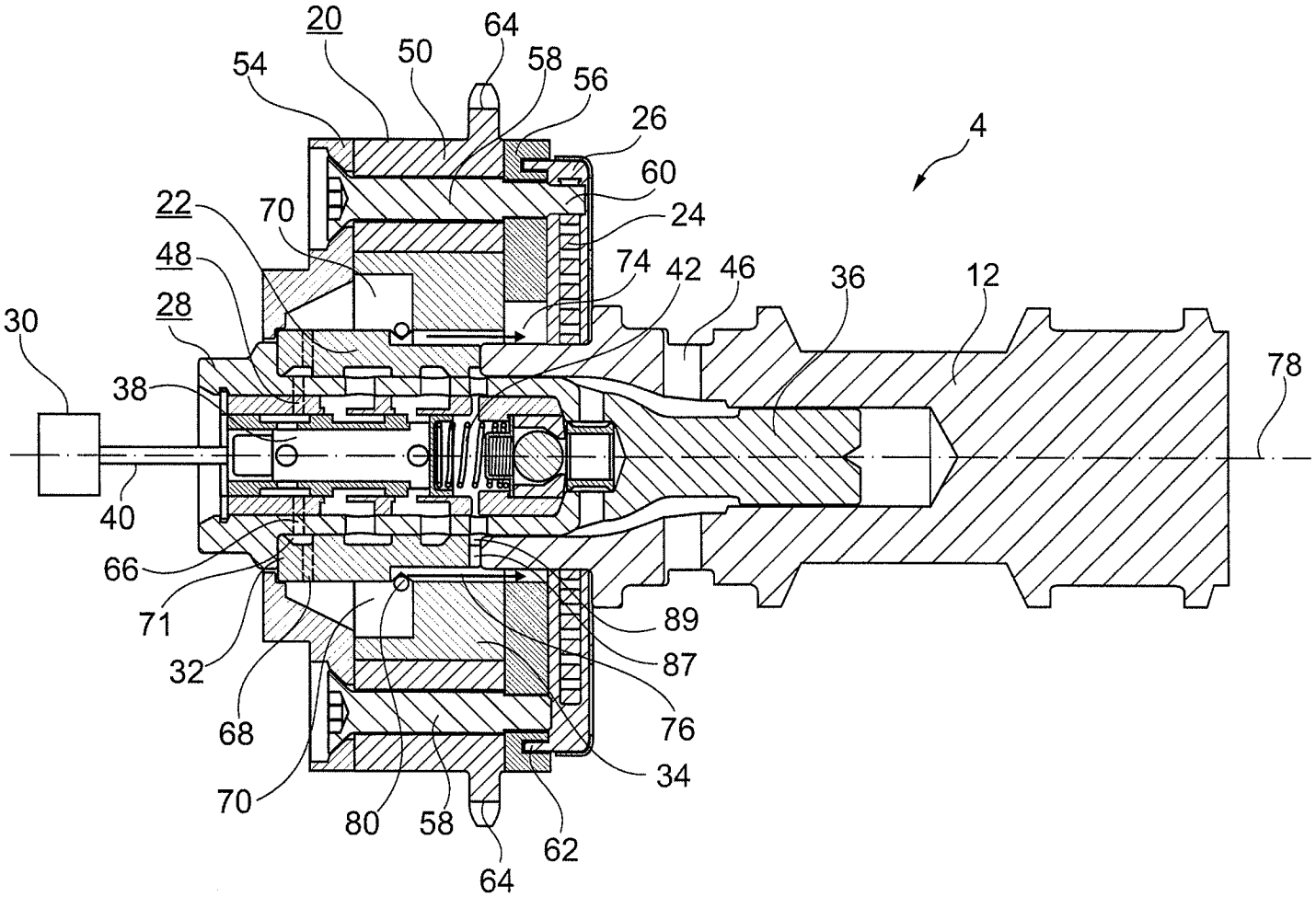
FIG. 2 shows a sectional view of a camshaft adjuster of FIG. 1.
Figure 3:
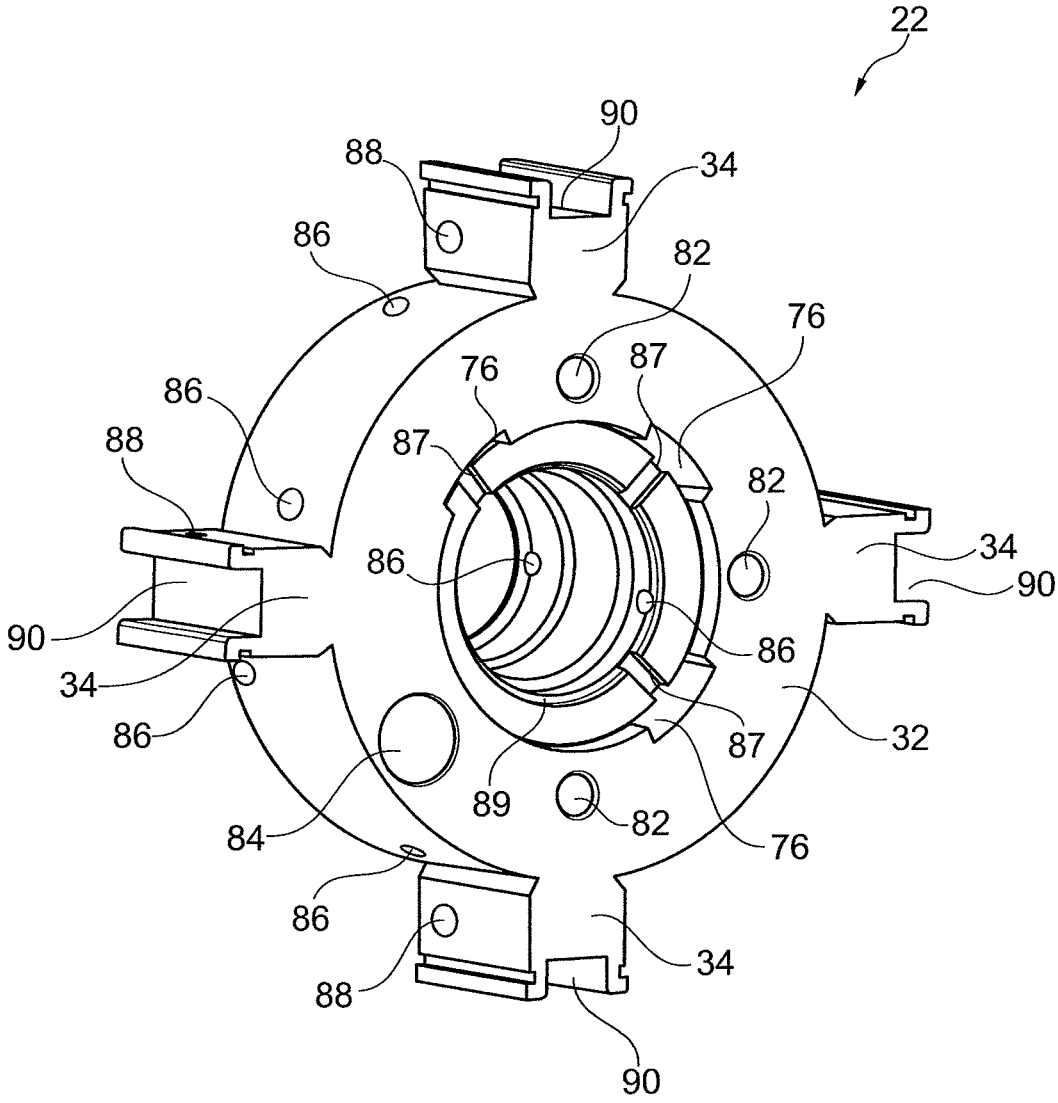
FIG. 3 shows a perspective view of a rotor of FIG. 2.

Reference is made to FIGS. 2 and 3 which show a sectional view of one of the camshaft adjusters 4 of FIG. 1.

The camshaft adjuster 4 has a stator 20 and a rotor 22 housed in the stator 20.

In addition to the stator 20, the camshaft adjuster 4 has a rotor 22 housed in the stator 20, a coil spring 24 pretensioning the stator 20 relative to the rotor 22, a spring cover 26 covering the coil spring, a central valve 28 housed centrally in the camshaft adjuster 4, and a central magnet 30 operating the central valve 28.

Figure 4:
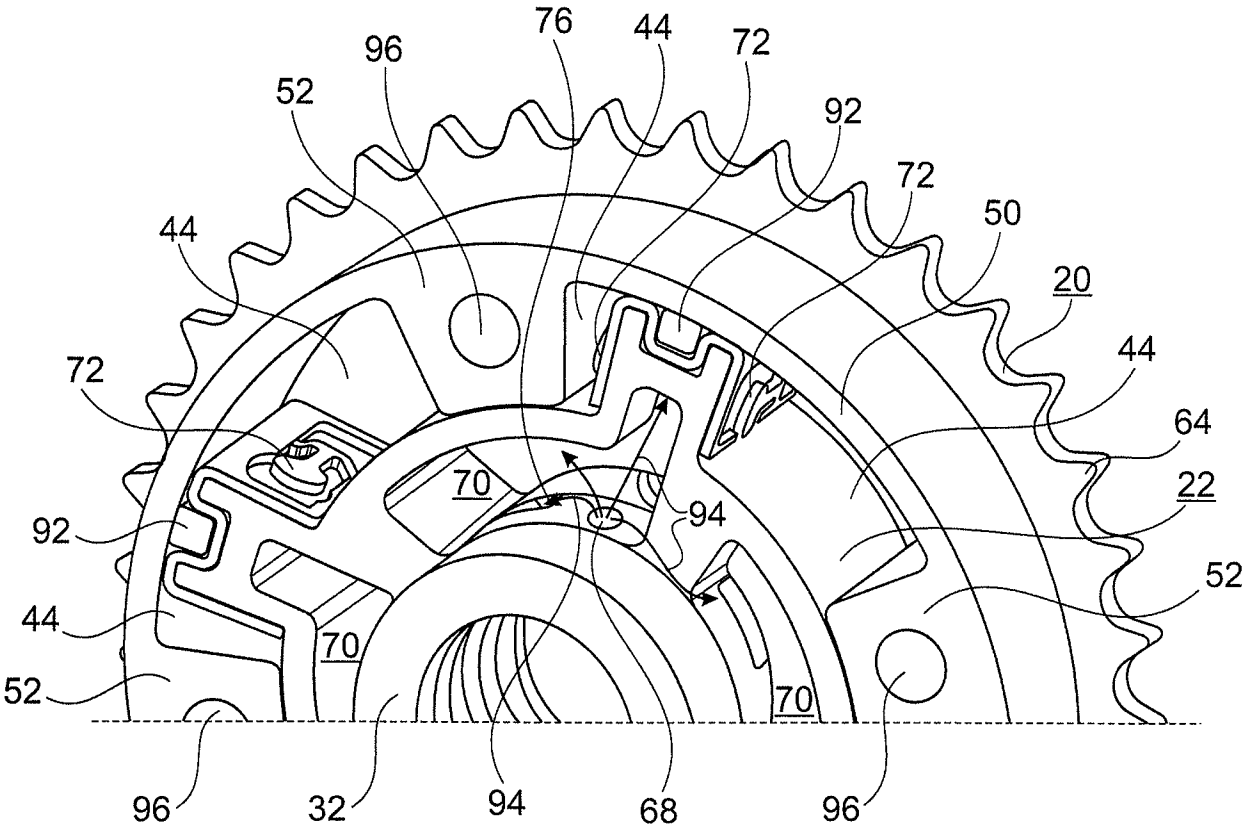
FIG. 4 shows a perspective partial view of the camshaft adjuster of FIG. 2.

The rotor 22 is housed concentrically in the stator 20 and has vanes 34 projecting from a hub 32 of the rotor as shown in FIGS. 3 to 5. The rotor 22 is held concentrically on a central screw 36 of the central valve 28 which can be screwed into one of the camshafts 12, and in which is housed an axially movable control piston 38, which can be moved by a tappet 40 of the central magnet 30 axially into the central screw 36 and can be forced axially out of the central screw 36 by a spring 42. Dependent on the position of the control piston 38 in the central screw 36, pressure chambers 44 of the camshaft adjuster 4 shown in FIG. 4 are connected in a manner known per se to a pressure connection 46 or to a volume accumulator connection 48, via which a hydraulic fluid can be correspondingly pumped into the pressure chambers 44 or can be let out therefrom.

The stator 20 has a ring-shaped outer part 50, which can be seen in FIGS. 3 and 4, from which segments 52 project radially inwards. The ring-shaped outer part 50 is axially closed with a front cover 54 and a rear cover 56, wherein the covers 54, 56 are held by screws 58 on the ring-shaped outer part 50. One of the screws 58 has an axial extension 60 which serves as a hanger for the coil spring 24. Furthermore in the rear cover 56 on the axial side opposite the ring-shaped outer part 50 there is formed a circumferential groove 62 in which the spring cover 26 is clamped. On the radial circumference of the ring-shaped outer part 50, teeth 64 are formed in which the drive means 18 can engage.

The central screw 36 has as volume accumulator connection 48, a radial bore 66 on which an axial channel 68 through the front cover 54 is placed. The channel 68 is set radially on a groove 71 guided in the circumferential direction on the radial inside of the front cover 54 directed towards the central screw 36, in order to allow a flow of the hydraulic fluid between the radial bore 66 and the channel 68 in any position of the central screw 36, connected in a rotationally secured manner to the rotor 22, relative to the stator 20.

The channel 68 runs into a hollow space 70. The hollow space 70 is opened by a non-return valve 72 to the adjoining pressure chamber 44 of the camshaft adjuster 4, wherein the flow of hydraulic fluid is possible solely from the hollow space 70 to the pressure chamber 44 so that, in the event of an underpressure, the pressure chamber 44 can draw in hydraulic fluid stored in the hollow space 70.

If the hollow space 70 overflows with too much hydraulic fluid, then the excess of hydraulic fluid is discharged through outlet channels 76 to a tank connection 74 which can discharge the hydraulic fluid emerging from the hollow space 70 to an oil sump (not shown) by way of example. The hollow space 70 therefore serves as a volume accumulator for compensating an underpressure in the corresponding adjoining pressure chamber 44 of the camshaft adjuster 4.

The outlet channels 76 are in the present design formed as through passages running axially through the rotor. Their openings on the side of the hollow space adjoin one side of the hollow space 70 which lies axially closest to a rotational axis 78 of the camshaft adjuster. The outlet channels 76 run from these openings on the side of the hollow space initially in the direction of the rotational axis 78 before they open in the axial direction parallel to the rotational axis 78 into the tank connection 74.

The openings of the outlet channels 76 on the side of the hollow space are closed with non-return valves 80. These non-return valves 80 open the openings of the outlet channels 76 on the side of the hollow space for a flow of hydraulic fluid from the outlet channel 76 in the hollow space 70, which initially appears contradictory. However, the non-return valves 80 are actuated in this way by the centrifugal force during the operation of the camshaft adjuster 4 and thus allow a flow from the hollow space 70 into the outlet channel 76 only during the operation of the camshaft adjuster 4. If the camshaft adjuster 4 is turned off, the hydraulic fluid remains in the hollow space 70 and remains available from the beginning during a restart of the camshaft adjuster 4.

Furthermore a radial bore 87 opens into the tank connection 74 through the rotor 22, and is connected to a radial bore (not referenced further) through the central screw 36 via a circumferential notch 89 which is formed on the inside of the rotor 22. These radial bores 87 open up a space in the central valve 28, in which the spring 42 is housed, and ventilate it.

Reference is made to FIG. 3 which shows a perspective view of a rotor 22 from the camshaft adjuster of FIG. 2.

The camshaft adjuster 4 comprises on its hub 32 axially extending bores 82 through which pins (not shown) can be guided on which the coil spring 24 can be hung on the rotor side. A locking pin (not shown) can be housed in a blind hole bore 84 guided axially through the hub 32 and this locking pin locks movement of the rotor 22 relative to the stator 20 until there is sufficient operating pressure built up in the pressure chambers 44 of the camshaft adjuster 4. Furthermore radial bores 86 can be guided through the hub 32 and supply and discharge hydraulic fluid to and from the pressure chambers 44 of the camshaft adjuster 4.

The hollow spaces 70, which are formed in the present design in the rotor 22, can be opened via circumferentially running bores 88 into the pressure chambers. As can be seen in FIG. 4, these circumferentially running bores 88 are closed with the non-return valves 72. Radial notches 90 can be formed inwardly at the radially outermost ends of the vanes 34 of the rotor 22 and house sealing elements 92 which seal the pressure chambers 44 off from one another.

Reference is made to FIG. 4 which shows a perspective partial representation of the camshaft adjuster 4 of FIG. 2.

The flow of the hydraulic fluid emerging from the pressure chambers 44 and entering into the hollow spaces which are designed as volume accumulators is indicated in FIG. 4 by arrows 94. As the arrows 94 indicate, the hollow spaces 70 are initially filled completely with hydraulic fluid through the centrifugal forces during operation of the camshaft adjuster 4. Only after the hollow spaces are filled completely with hydraulic fluid can the overflowing hydraulic fluid emerge through the openings of the outlet channels 76 on the hollow chamber side.

The non-return valves 80 were omitted from FIG. 4 for a clearer representation of the situation.

As is further apparent from FIG. 4, through bores 96 through which the screws 28 can be guided extend through the segments 52 of the stator 20.

LIST OF REFERENCE NUMERALS

2 Internal combustion engine
4 Camshaft adjuster
6 Combustion chamber
8 Valve
10 Cam
12 Camshaft
14 Reciprocating piston
16 Crankshaft
18 Drive means
20 Stator
22 Rotor
24 Coil spring
26 Spring cover
28 Central valve
30 Central magnet
32 Hub
34 Vane
36 Central screw
38 Control piston
40 Tappet
42 Spring
44 Pressure chamber
46 Pressure connection
48 Volume accumulator connection
50 Ring-shaped outer part
52 Segment
54 Front cover
56 Rear cover
58 Screw
60 Axial extension
62 Groove
64 Tooth
66 Radial bore
68 Channel

70 Hollow space
71 Circumferential groove
72 Non-return valve
74 Tank connection
76 Outlet channel
78 Rotational axis
80 Non-return valve
82 Axial through bore
84 Axial blind hole bore
86 Radial bore
87 Radial bore
88 Circumferential bore
89 Circumferential notch
90 Radial notch
92 Seal
94 Arrow
96 Axial through bore

The invention claimed is:

1. A camshaft adjuster for a camshaft of an internal combustion engine, comprising a stator, a rotor housed concentrically in the stator and mounted rotatably about a rotational axis relative to the stator, and a volume accumulator located within the rotor for receiving hydraulic fluid from a pressure chamber formed between the rotor and the stator, the volume accumulator has an outlet in a direction of the rotational axis.

2. The camshaft adjuster as claimed in claim 1, further comprising a tank connection connected to the volume accumulator through the outlet for discharging the hydraulic fluid to a tank, and the tank connection is arranged radially lower than the volume accumulator.

3. The camshaft adjuster as claimed in claim 2, wherein the outlet has a circular, kidney-shaped or rectangular cross section.

4. The camshaft adjuster as claimed in claim 1, further comprising an axial front side and an axial rear side opposite the axial front side, and the outlet is arranged on at least one of the axial front side or on the axial rear side.

5. The camshaft adjuster as claimed in claim 1, further comprising a valve in the outlet, which is provided for opening the outlet based on an operation of the internal combustion engine.

6. The camshaft adjuster as claimed in claim 5, wherein the valve comprises a closing body which is movable radially relative to the rotational axis, and is counter-supported by a spring on the outlet.

7. The camshaft adjuster as claimed in claim 6, wherein the closing body has a shape of a ball, a cone or a plate.

8. The camshaft adjuster as claimed in claim 5, wherein the valve is a pressure-relief valve.

9. An internal combustion engine, comprising a combustion chamber, a crankshaft driven by the combustion chamber, a camshaft controlling the combustion chamber, and the camshaft adjuster as claimed in claim 1 for transferring rotational energy from the crankshaft to the camshaft.

10. The internal combustion engine as claimed in claim 9, further comprising a cylinder head for mounting the camshaft, and the outlet is guided through the cylinder head.

* * * * *